US006019377A

United States Patent [19]

Chiu et al.

[11] Patent Number: 6,019,377

[45] Date of Patent: Feb. 1, 2000

[54] SKATE HAVING AN EASILY ASSEMBLING STRUCTURE

[76] Inventors: Jui-Hsia Chiu, No.161-1, Section 2, Tan-Fu Road, Tan-Tzu Hsiang, Taichung Hsien; Tuan Chang, No.6, Lane 133, Shih-Fu Road, Taichung City, both of Taiwan

[21] Appl. No.: 09/080,184

[22] Filed: May 18, 1998

[51] Int. Cl.[7] ..... A63C 17/00

[52] U.S. Cl. ..... 280/11.19; 280/11.22; 280/11.3; 280/11.31

[58] Field of Search ..... 280/11.2, 7.12, 280/7.13, 7.14, 841, 11.3, 11.31, 613, 634, 11.33, 11.18, 11.17, 11.27, 11.19, 11.22; 301/5.3; 188/29; 403/322.1, 325, 321

[56] References Cited

U.S. PATENT DOCUMENTS 5,277,437 1/1994 Moats ..... 280/11.23
5,314,199 5/1994 Olson et al. ..... 280/7.13
5,507,506 4/1996 Shadroui ..... 280/11.22
5,645,287 7/1997 Soo ..... 280/11.2
5,735,536 4/1998 Myers et al. ..... 280/7.13
5,741,019 4/1998 Lu ..... 280/11.22

*Primary Examiner*—Lanna Mai
*Assistant Examiner*—Hau V. Phan
*Attorney, Agent, or Firm*—Charles E. Baxley, Esq.

[57] ABSTRACT

A skate includes a boot having a rod secured to the front of the bottom portion and having a channel formed in the rear of the bottom portion. A frame has a rear latch for slidably engaging with the channel and includes a lock pivotally secured to the front portion. The lock includes a hook for engaging with the rod and for securing the front portion of the frame to the boot, and includes a spring for biasing the hook of the lock to engage with the rod of the boot. The hook may be moved over the rod and biased to engage with the rod and may be disengaged from the rod against the spring such that the frame may be easily secured to and disengaged from the boot.

5 Claims, 3 Drawing Sheets

SKATE HAVING AN EASILY ASSEMBLING STRUCTURE

BACKGROUND OF THE INVENTION

1. Field of the Invention

The present invention relates to a skate, and more particularly to a roller skate having a structure that may be easily assembled together.

2. Description of the Prior Art

Typical roller skates comprise a boot secured on top of a frame to which a number of wheels are secured. The boot may not be disengaged from the frame for replacing with another boot of different size.

The present invention has arisen to mitigate and/or obviate the afore-described disadvantages of the conventional skates.

SUMMARY OF THE INVENTION

The primary objective of the present invention is to provide a skate having a structure that may be easily assembled and disassembled.

In accordance with one aspect of the invention, there is provided a skate comprising a boot including a bottom portion having a front portion and a rear portion, and including a rod secured in the front portion and including a channel provided in the rear portion, a frame including a rear portion having a latch for slidably engaging with the channel and for securing the rear portion of the frame to the boot, the frame including a front portion, a lock pivotally secured to the front portion of the frame and including a first end having a hook for engaging with the rod and for securing the front portion of the frame to the boot, and means for biasing the hook of the lock to engage with the rod of the boot.

The front portion of the frame includes a shaft, the lock is pivotally secured to the frame at the shaft. The front portion of the frame includes a pair of walls extended upward, the shaft is secured between the walls.

The frame includes an upper and middle portion having a notch, the lock includes at least one hand grip extended outward of the frame via the notch, for allowing the lock to be depressed against the biasing means.

The front portion of the bottom portion of the boot includes a depression, the boot includes a bracket secured in the depression, the rod is secured in the bracket.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
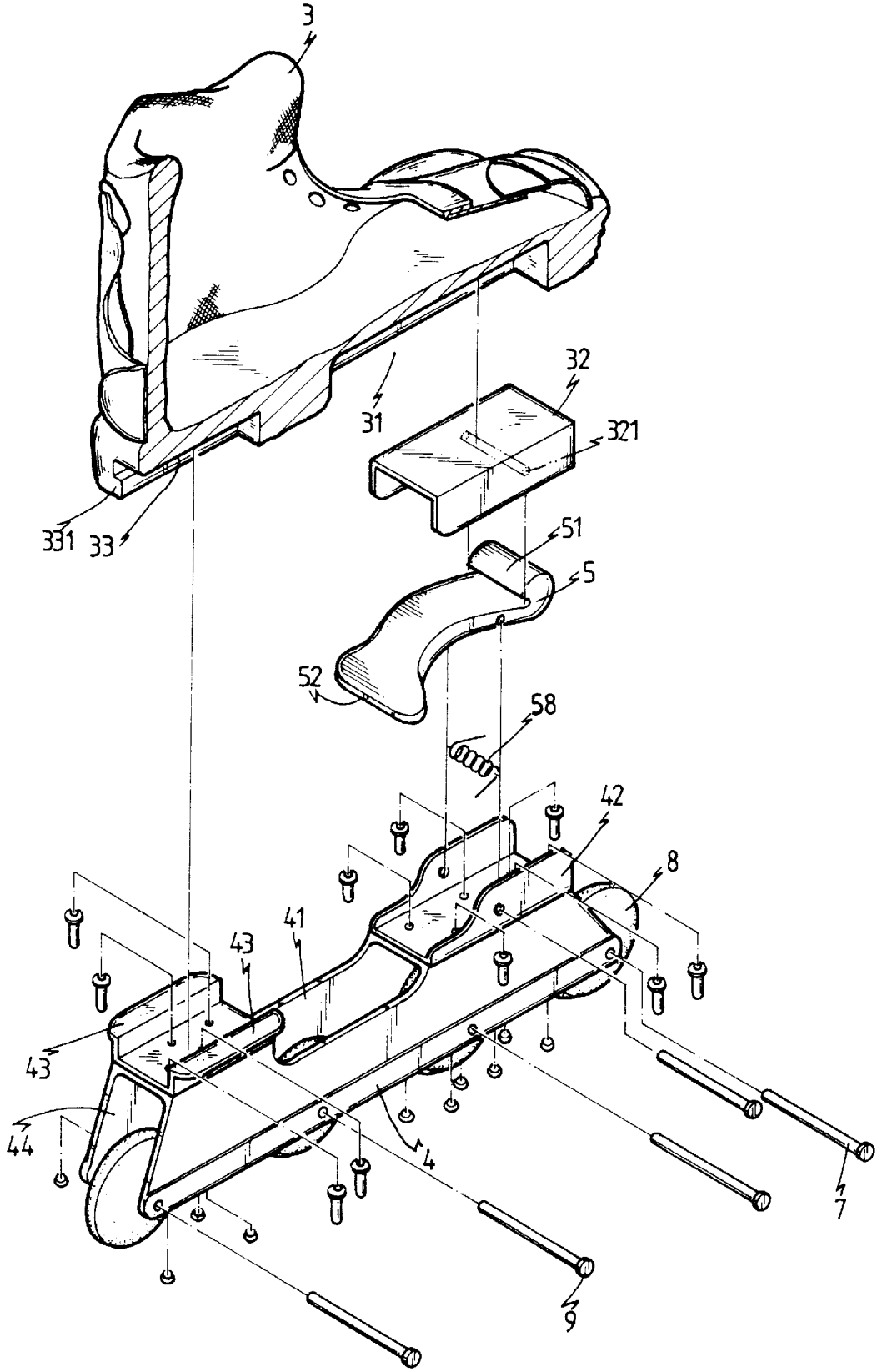
FIG. 1 is an exploded view of a skate in accordance with the present invention.
Figure 2:
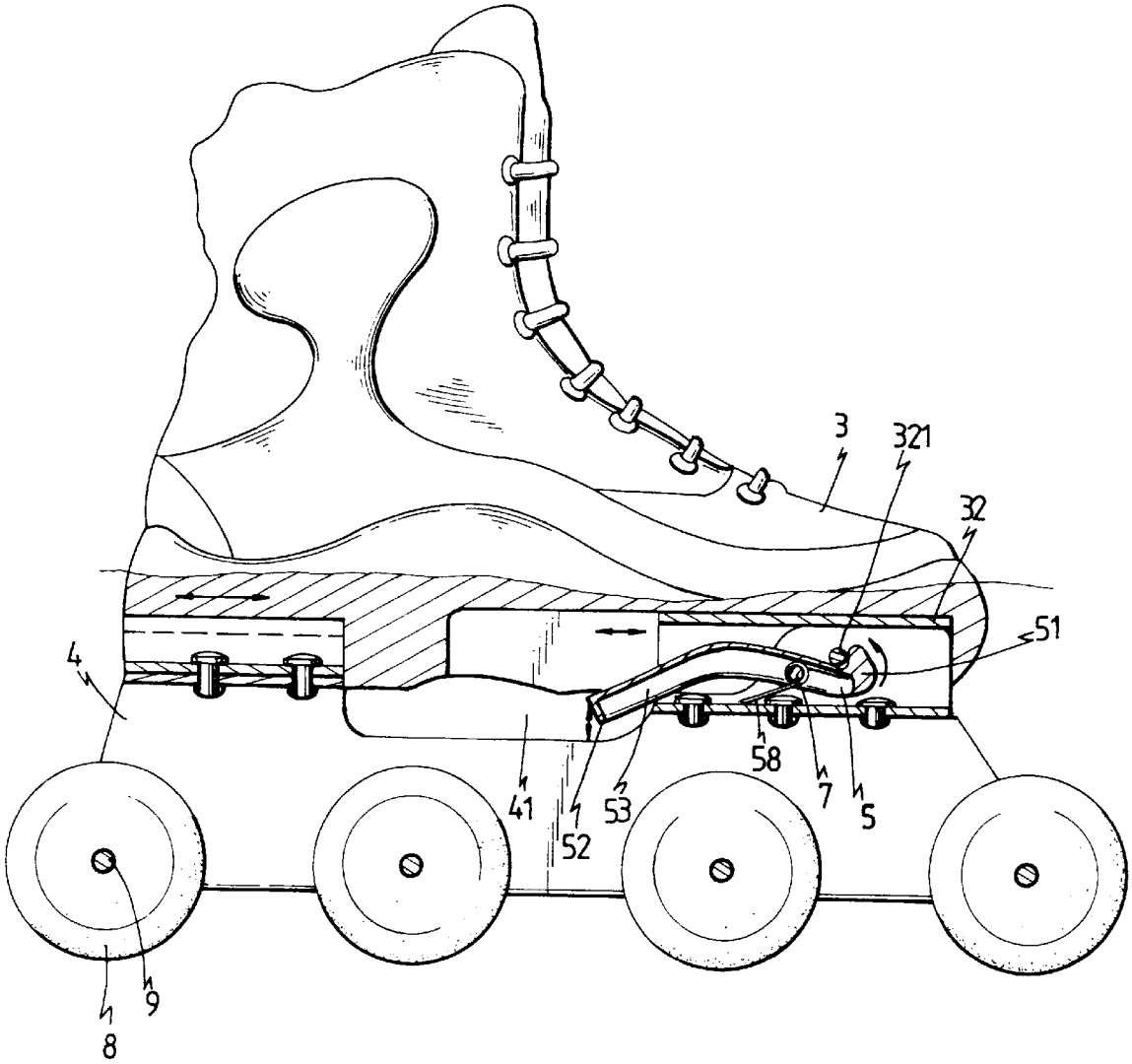
FIG. 2 is a side view of the skate, in which a portion of the skate is cut off for showing the inner structure of the skate.

Referring to the drawings, and initially to FIGS. 1 and 2, a skate in accordance with the present invention, particularly a roller skate, comprises a boot 3 for securing on top of a frame 4. The boot 3 includes a depression 31 formed in the front of the bottom portion and includes a T-shaped channel 33 formed in the rear portion and defined by a pair of inward extended flanges 331. A bracket 32 is secured in the depression 31 by such as welding process or by adhesive materials, and a rod 321 is laterally secured in the bracket 32.

Figure 3:
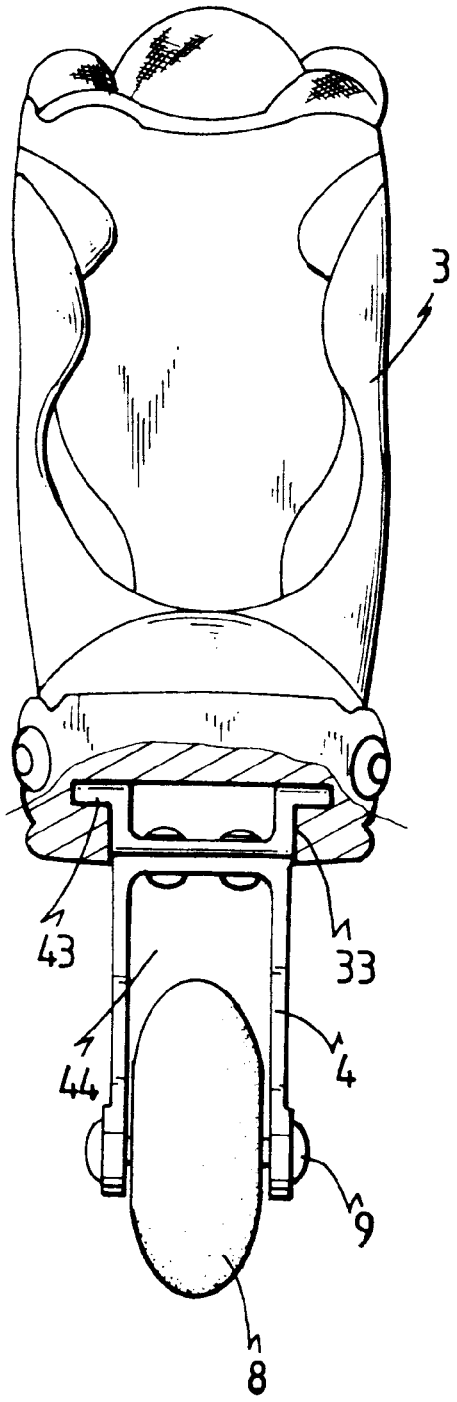
FIG. 3 is a rear plan view of the skate.

The frame 4 includes a notch 41 formed in the upper and middle portion and includes a slot 44 formed in the lower portion for rotatably securing two or more wheels 8 by axles 9. The frame 4 includes a latch 43 defined by a pair of outwardly extending flanges for slidably engaging with the channel 33 (FIG. 3) and for securing the rear portion of the frame 4 to the boot 3. The frame 4 includes a pair of walls 42 extended upward. A lock 5 is pivotally secured to the front portion of the frame 4 and secured between the wall 42 at a pivot shaft 7. The lock 5 includes a lower portion 53 for receiving the shaft 7 and includes a hook 51 formed in the front end for engaging with the rod 321 and for locking the frame 4 to the boot 3. A spring 58 is engaged on the shaft 7 and engaged with the lock 5 for biasing the hook 51 to engage with the rod 321. The lock 5 includes a rear portion engaged in the notch 41 of the frame and having a pair of hand grips 52 laterally extended outward of the frame 4 for allowing the user to rotate the lock 5 against the spring 58 and to disengage the hook 5 from the rod 321.

In assembling the skate, the walls 42 and the lock 5 is first engaged in the depression 31 of the boot 3. The latch 43 of the frame 4 is then engaged into the channel 33 for securing the rear portion of the frame 4 to the boot 3. When the hook 51 is engaged with the rod 321, the hook 51 may be moved downward and moved over the rod 321 against the spring 58, such that the hook 51 may be biased to engage with the rod 321 and such that the frame 4 may be easily secured to the boot 3. When it is required to disengage the boot 3 from the frame 4, it is only required to depress the hand grip(s) 52 of the lock 5 against the spring 58 for disengaging the hook 51 from the rod 321, such that the frame 4 may be moved rearward relative to the boot 3 and may thus be easily disengaged from the boot 3.

It is to be noted that the bracket 32 is solidly secured to the boot 3. The walls 42 are slidably engaged in and/or slidably engaged with the bracket 32 such that the front portion of the boot 3 may be prevented from moving laterally relative to the frame 4, and such that the rear portions of the boot 3 and the frame 4 may be prevented from being damaged.

Accordingly, the skate in accordance with the present invention includes a structure that may be easily assembled and disassembled.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A skate comprising:

a boot including a bottom portion having a front portion and a rear portion, and including a rod secured in said front portion and including a channel provided in said rear portion, a frame including a rear portion having a latch slidably engaging with said channel and securing said rear portion of said frame to said boot, said frame including a front portion, a lock pivotally secured to said front portion of said frame and including a first end having a hook engaging with said rod and securing said front portion of said frame to said boot, and means for biasing said hook of said lock to engage with said rod of said boot.

2. The skate according to claim 1, wherein said frame includes an upper and middle portion having a notch, said lock includes at least one hand grip extended outward of said frame via said notch, allowing said lock to be depressed against said biasing means.

3. The skate according to claim 1, wherein said front portion of said bottom portion of said boot includes a depression, said boot includes a bracket secured in said depression, said rod is secured in said bracket.

4. The skate according to claim 1, wherein said front portion of said frame includes a shaft, said lock is pivotally secured to said frame at said shaft.

5. The skate according to claim 4, wherein said front portion of said frame includes a pair of walls extended upward, said shaft is secured between said walls.

* * * * *